United States Patent [19]

Davis

[11] 4,005,535

[45] Feb. 1, 1977

[54] PROGRESSIVELY REVEALED DISPLAY

[76] Inventor: James F. Davis, 17154 Nordhoff St., Northridge, Calif. 91324

[22] Filed: Apr. 11, 1974

[21] Appl. No.: 459,928

[52] U.S. Cl. ..... 40/30; 40/31; 40/32; 40/61 A

[51] Int. Cl.[2] ..... G09F 11/00

[58] Field of Search ..... 35/9 A, 9 E; 40/28 C, 40/30, 31, 32, 52 R, 61 A, 65, 63 A, 96, 96.5, 106.1, 106.51, 106.52, 106.53, 130 R, 130 B, 64 R, 86 R; 198/203; 352/183

[56] References Cited

UNITED STATES PATENTS

| | | | |
|---|---|---|---|
| 1,607,934 | 11/1926 | Yearby | 40/32 |
| 1,809,378 | 6/1931 | Eschenbach | 40/32 X |
| 1,928,012 | 9/1933 | Eschenbach | 40/32 |
| 3,384,986 | 5/1968 | Davis | 40/130 R |
| 3,467,467 | 9/1969 | Walters | 352/183 |
| 3,469,903 | 9/1969 | Grichnik et al. | 40/32 X |
| 3,526,983 | 9/1970 | Klauber | 40/106.53 |
| 3,664,050 | 5/1972 | Manzano | 40/61 A X |
| 3,792,540 | 2/1974 | Watanabe et al. | 40/28 C |

FOREIGN PATENTS OR APPLICATIONS

| | | | |
|---|---|---|---|
| 686,140 | 4/1930 | France | 40/32 |

*Primary Examiner*—Paul E. Shapiro
*Assistant Examiner*—Vance Y. Hum
*Attorney, Agent, or Firm*—Alan C. Rose

[57] ABSTRACT

The display has a mask positioned in front of it so that an opaque part of the mask prevents viewing the display. There may be several masks for different parts of the display. The masks are preferably in the form of tapes having opaque and transparent areas. The tape-masks are intermittently and/or sequentially moved to progressively reveal the display. The display may consist of one or more lines of pictorial, textual, or three-dimensional matter.

15 Claims, 12 Drawing Figures

Fig. 1
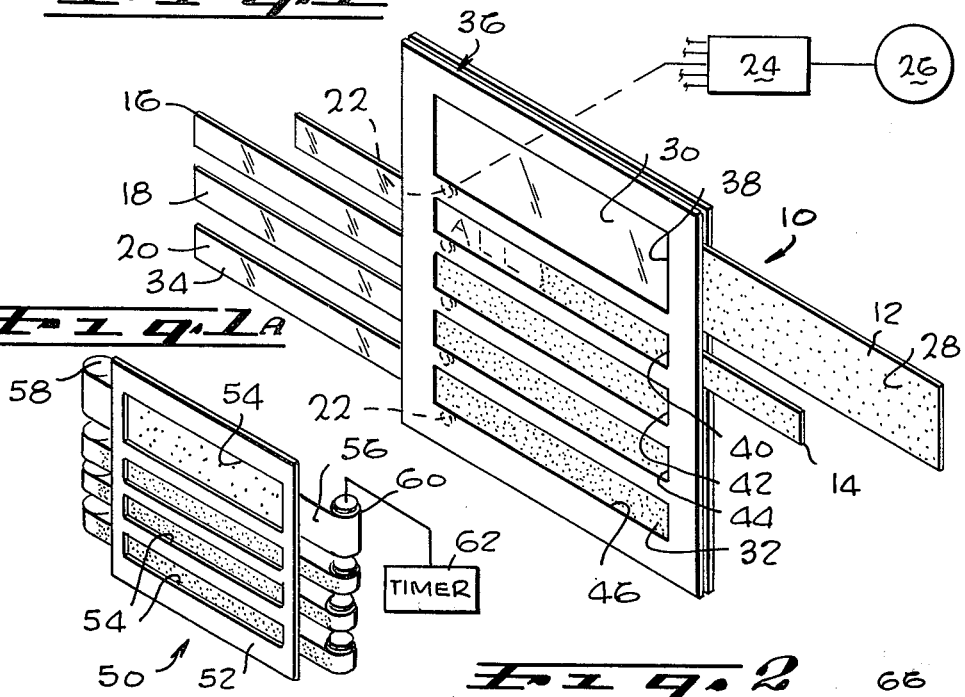
Fig. 1A
Fig. 2
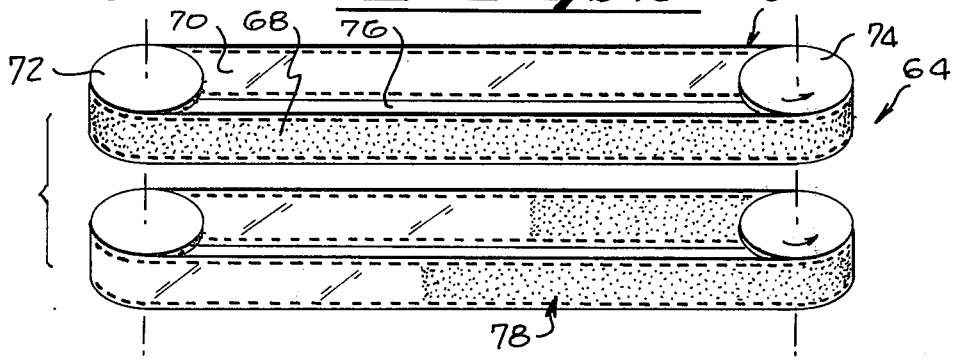
Fig. 3a
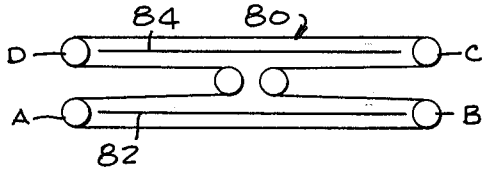
Fig. 3B
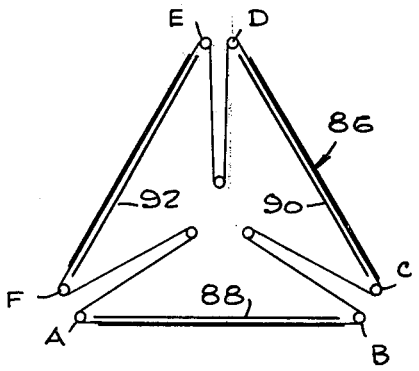
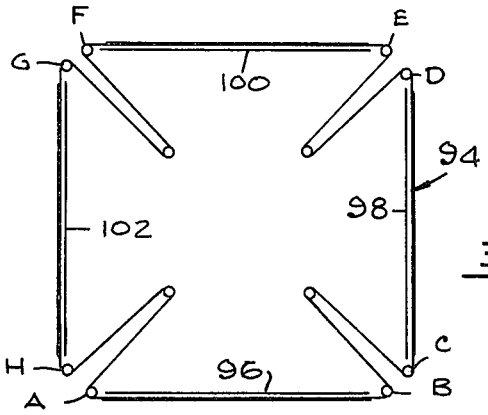
Fig. 3c Fig. 4
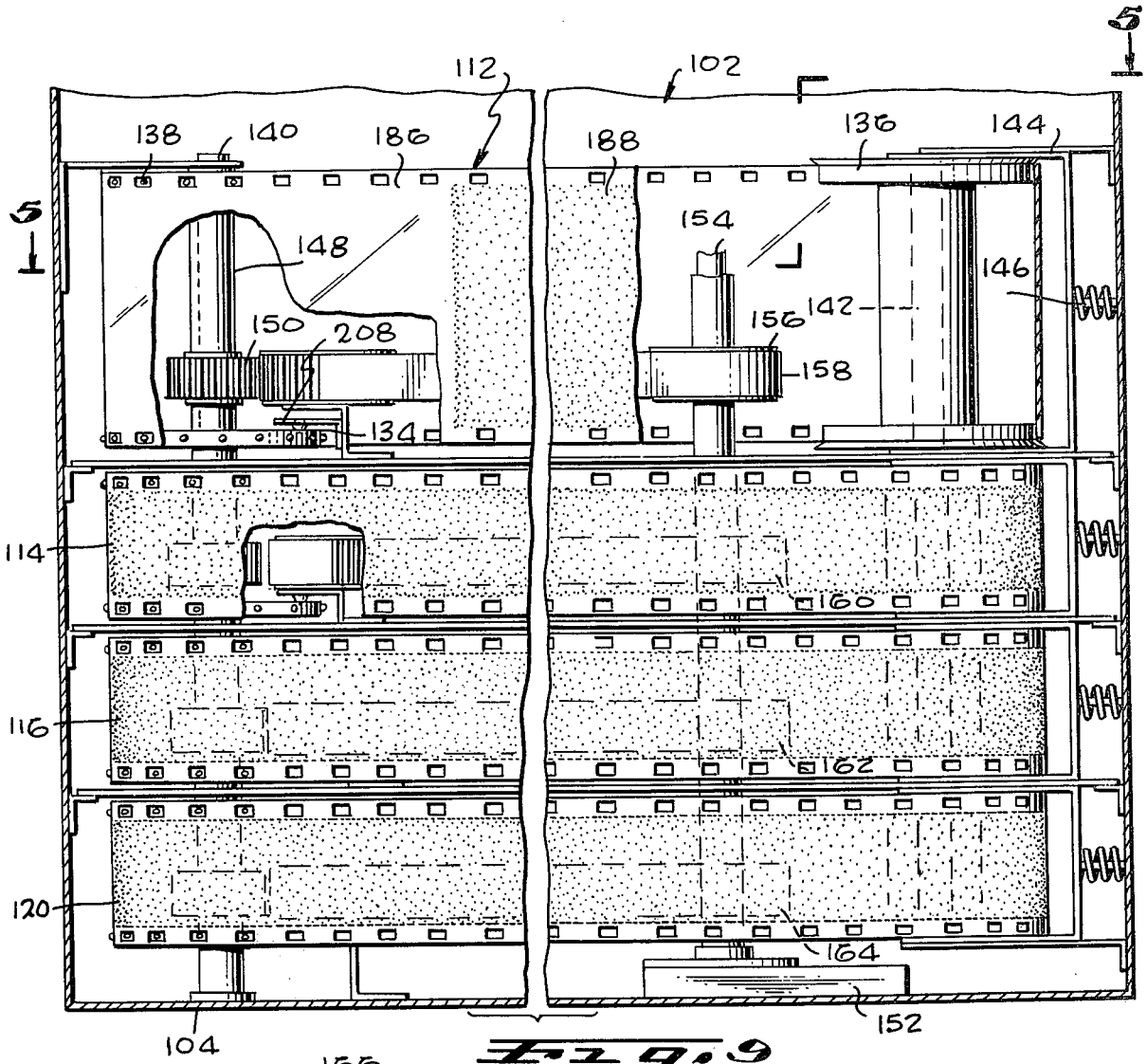
Fig. 9
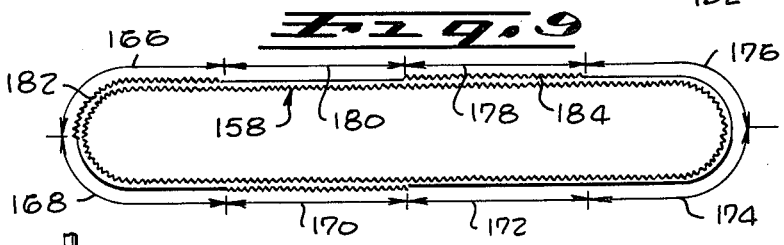
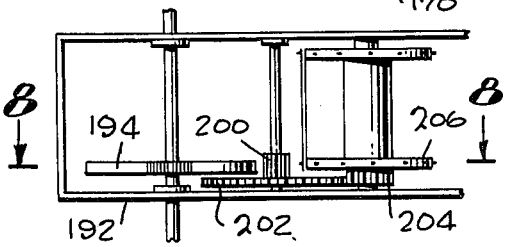
Fig. 7
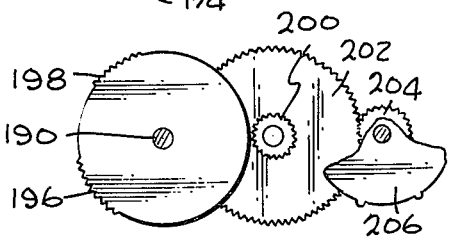
Fig. 8

PROGRESSIVELY REVEALED DISPLAY

BACKGROUND OF THE INVENTION

1. Field of the Invention

This invention is directed to a progressively revealed display, and particularly to a structure where masks in front of the display are progressively moved to progressively reveal the display.

2. Description of the Prior Art

My previous U.S. Pat. No. 3,384,986, granted May 28, 1968, and entitled "Progressively Illuminated Sign" is directed to the concept of the progressive presentation of information. This prior patent teaches a useful and valuable structure. It calls for a belt shutter to be interposed between the light source and rows of information to be illuminated. The rows of information to be progressively illuminated must be either edge-lighted or back-lighted for progressive illumination by continuous belt motion, and thus this device is limited in application to displaying information which may be formed on transparent or translucent slats or sheets or on letter blocks. The sign of my prior patent is thus particularly adapted for use with removable letter means so that the information can be quickly and locally changed. However, it is limited by this arrangement of shutter controlled illumination of the letter means.

SUMMARY OF THE INVENTION

In order to aid in the understanding of this invention, it can be stated in essentially summary form that it is directed to a progressively revealed display. The display may be lighted in any convenient manner, from the front, back or edge, or may be selfluminous, and has a moving mask positioned in front of it. The moving mask has an opaque area and an area which does not obstruct viewing of the display. The mask is progressively moved to progressively reveal the display. A series of masks are sequentially progressively moved to progressively reveal each sequential portion of the display.

It is thus an object of this invention to provide an apparatus for sequentially revealing a display consisting of one or more lines of pictorial, textual, or three-dimensional matter. It is another object to provide a display having a movable mask positioned in front thereof to progressively expose the display for viewing. It is a further object to provide a plurality of masks which can be intermittently and sequentially moved. It is yet another object to provide a plurality of masks each in the form of a flexible tape, with each of the masks having an area which inhibits viewing of the display and another which permits viewing of the display.

The features of the present invention which are believed to be novel are set forth in particularity in the appended claims. The present invention, both as to its organization and manner of operation, together with further objects and advantages thereof, may be understood best by reference to the following description taken in connection with the accompanying drawings.

BRIEF DESCRIPTION OF THE DRAWINGS

FIG. 1 is an isometric view of an elementary embodiment of a device for progressively revealing a display of this invention wherein the moving masks are in the form of slats.

FIG. 1A is another elementary embodiment of the progressively revealed display device wherein the moving masks are in the form of flexible tapes which wind from one reel to another and then are rewound.

FIG. 2 shows an embodiment of the device wherein the tapes for masking are continuous, so that they need be moved in only one direction.

FIG. 3A is a schematic plan view of an embodiment of this invention wherein there are two displays and a single continuous tape for masking progressively reveals each of the displays.

FIG. 3B is similar to FIG. 3A and shows an arrangement where three displays are progressively revealed by a continuous tape for masking.

FIG. 3C is similar to FIG. 3A and shows an arrangement where four displays are progressively revealed by a single tape for masking.

FIG. 4 is a front elevational view of the preferred embodiment of the progressively revealed display of this invention, with the front removed and parts broken away to show the operating mechanism.

FIG. 7 is a partial front elevational view of another intermittent mechanism for driving the tape for progressively revealing the display.

FIG. 8 is a section taken generally along the line 8—8 of FIG. 7.

FIG. 9 is a reduced plan view of one embodiment of the special toothed belt employed in connection with the preferred embodiment of the display of this invention.

DESCRIPTION OF THE PREFERRED EMBODIMENTS

Figure 5:
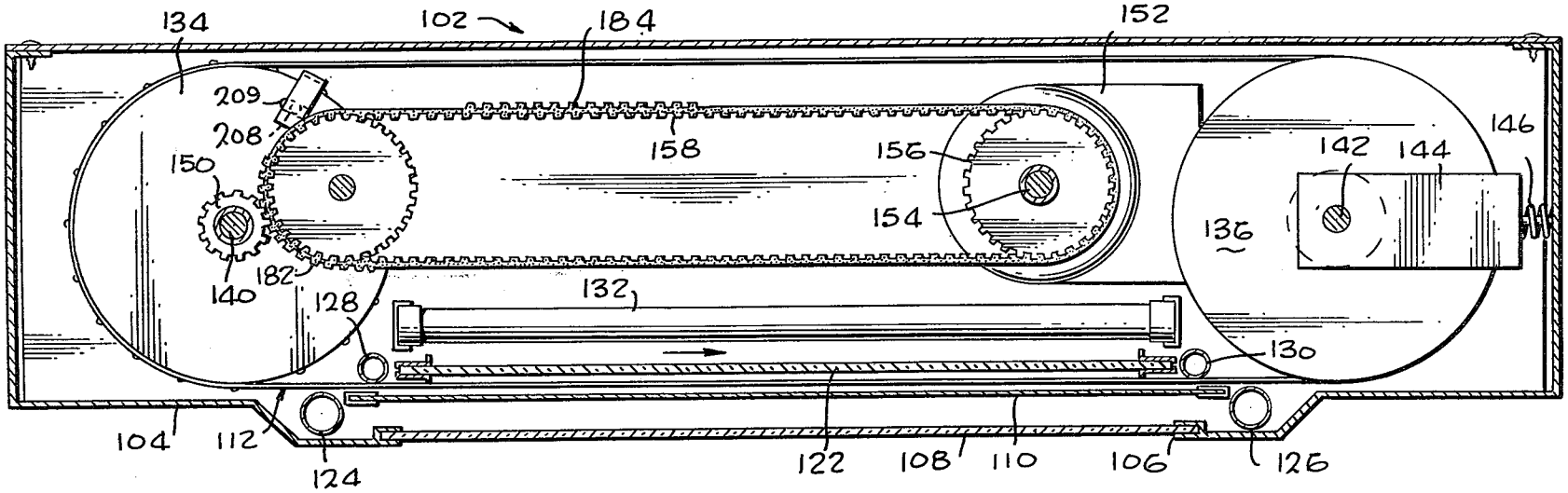
FIG. 5 is a section taken generally along line 5—5 of FIG. 4.

FIGS. 1, 1A and 2 illustrate three different embodiments of mask for the device for sequentially revealing a display. In FIG. 1 the device is generally indicated at 10. It comprises a plurality of individual slats 12, 14, 16, 18, and 20. Each slat is mounted on a rack so that the slat can be moved by a pinion gear. Pinion 22 is positioned at the bottom of slat 12 and engages the slat for driving it. The additional pinions for the additional racks are shown below pinion 22. Each of the pinions is connected to be driven by a gear box 24 which also contains a timer for sequentially powering the plural outputs of the gear box. Motor 26 serves as the power input to the gear box. Each of the slats 12 through 20 is formed with an opaque area and a transparent area. The opaque area of slot 12 is shown at 28, while its transparent area is shown at 30. Similarly, the opaque area of slat 20 is shown at 32 and its transparent area at 34.

Each of the slats is relatively movable in stationary frame 36. Frame 36 is in the form of an opaque overlay stationary mask which defines openings 38, 40, 42, 44, and 46 which respectively correspond to the slat masks 12 through 20, respectively. With each of the movable masks in its left-most position, each of the openings is closed or obscured. With each of the movable masks in its right-most position, each of the openings permits vision therethrough. Thus, the frame 36 is a stationary mask which prevents seeing nondesired edge portions of the interior parts and defines the viewable areas.

The display consists of one or more lines of text and/or one or more lines of pictures. The display can be a front-lighted sheet of original art or printed matter, or can be a back-lighted transparency, an edge-lighted display or a self-lighted electronic display. The overlay mask and slat masks closely overlay the display and are cooperatively designed so that the openings of the mask frame are closely aligned with picture-text matter shown on the display. Each of these slat-masks has an opaque area of sufficient length to opacify the respective openings in the frame when the slat-mask is so positioned. Similarly, it has a sufficient transparent area so that when appropriately positioned, the openings in the frame mask are exposed for vision therethrough. In such a position, the display behind can be seen. The slat-masks are successively moved across the face of the display. The slat-masks are initially in the left-most position, and each slat is successively moved across the face. As a result, the picture-text of the display is progressively revealed at the juncture line of the opaque and clear areas of the slats as they are moved across the display. The slat-masks are moved at an easy reading speed. An animated effect is gained with the picture being wiped on, and the text appears to be spelled out a letter at a time in accustomed reading order, left to right and downward through the text. As previously described, each slat is mounted to be driven across the face by a pinion gear. Successive motion of the slats, from top to bottom, is accomplished by gear box-timer 24. When all of the slat-masks are to the right, vision position, they are all returned at one time to the left-most opaque position to start over again. The casing for the device of FIG. 1 would necessarily include a housing of sufficient width to enclose the slat-masks in both their left and right positions, as well as the frame-overlay mask, the driving structure, and the display itself.

In an alternative structure, an individual motor could be located to drive each slat-mask, with the timer successively energizing the motors and finally returning all the masks to the starting point.

Throughout this disclosure, masks are referred to as having transparent and opaque areas, with the masks being moved for sequentially revealing a display. As far as the transparent areas are concerned, they include physical openings in the mask, transparent areas in the mask, tinted transparent areas so that colors are employed in the mask which do not interfere with vision of the display, but in some cases may enhance the vision thereof or the contrast. Reference to the transparent parts of the mask also include mostly transparent but slightly translucent areas which may, for some purposes, be employed to give a misty appearance to the display, when desired. On the other hand, the opaque part of the mask can include areas which are opaque, or which are translucent and nearly opaque. Furthermore, the opaque areas may include for some purposes areas which are translucent to an extent that a hint of the display therebehind is received. In other words, the transparent areas are intended to be areas where seeing of the display is achieved, and the opaque areas are intended to be areas where adequate seeing of the display is not achieved.

FIG. 1A illustrates device 50 for sequentially revealing a display. Device 50 is similar to device 10 illustrated in FIG. 1. It has a similar frame-overlay mask 52 with a series of openings 54 therein. There is a tape-mask 56 for each of the openings. The identified parts belong to the upper opening, but similar structures are provided for each of the openings therebelow. Each of the tape-masks 56 has an opaque area and a clear area. Tape 56 is initially wound on a reel in cartridge 58. In that position it has an opaque area in opening 54. Guides on the back of frame-overlay mask 52 hold the tape properly in place with respect to the opening. Tape mask 56 has its front end attached to reel 60 which is motor driven. Conveniently, the motor is interiorly of the reel. Timer 62 sequentially energizes the several motors to successively wind the tapes onto the right-hand reels. As each tape is wound to the right, its opaque area is pulled away and its transparent area is pulled into the opening, to progressively reveal the display therebehind. Each tape-mask is successively energized to successively reveal the display. The display is of the same nature as described with respect to device 10. When all of the tape-masks are in the right-most position, at the end of the cycle, they are all momentarily held in this position and then they are all returned to the left by rewinding. This rewinding can be done conveniently by electric or spring motors in the left reels to return the tapes. This is another device in which the display is progressively and sequentially revealed. Of course a case is employed to enclose the structure of FIG. 1A, so that of the active mechanism, only the front of frame-overlay mask 52, the tapes and the displays therebetween are seen. All mechanical structure required would be within the case to permit the unit to be used for either indoor or outdoor display purposes.

FIG. 2 illustrates another broad concept of mask arrangement in a device 64 for sequentially revealing a display. The device of FIG. 2 is the schematic illustration of the preferred embodiment described in more detail herebelow. Device 64 comprises a flexible continuous strip mask 66, conveniently in the form of a continuous tape having an opaque length 68 and a clear length 70. Clear length 70 is of sufficient length to completely reveal the display, when it is in front of the display, and opaque length 68 is also of such length to completely cover the display when so positioned. Preferably, the opaque length and clear length are equal. Mask 66 is in the form of a continuous loop of tape extending over sprockets 72 and 74 to leave a space 76 between the lengths of tape. An electromechanical means, such as a motor connected to sprocket 74, turns the sprocket wheels counter-clockwise as seen in FIG. 2, so that the left edge of the opaque area of the tape moves left to right across the face of the display and the clear area of the tape progressively reveals the display. Preferably the display has several lines, one above the other, and a separate mask 78 is positioned over each additional line. Mask 78 is similarly supported in sprockets and is appropriately motivated to move to progressively reveal the second line of the display, when the first line is fully revealed. After all of the lines are revealed, all tape masks are turned together, preferably in the same forward direction, until the display is obscured. A housing encases the masks, their sprockets and drive means, as well as the display and possibly its illumination, so that well structure is unitized and protected. Furthermore, the tape masks preferably operate in conjunction with the frame-overlay mask, such as 52, so that the masks 66 and 78 only control vision of the display through openings, and the portions between the tapes are permanently masked off.

FIGS. 3A, 3B, and 3C illustrate structures in which tape-masks can be employed to progressively reveal multifaced displays. In FIG. 3A, mask 80, in the form of a flexible continuous tape having two clear and two opaque areas, is engaged around a plurality of sprockets and around planar displays 82 and 84, seen edgewise in FIG. 3A. In FIG. 3B, flexible continuous tape mask 86 is engaged around appropriate sprockets and arranged around displays 88, 90, and 92. The displays are triangularly arranged in FIG. 3B. A four-faced display, with each face sequentially revealed, is illustrated in FIG. 3C. In this case, flexible continuous loop tape-mask 94 is engaged around displays 96, 98, 100, and 102. As illustrated in FIG. 3C, the mask extends around appropriate sprockets and the displays are positioned in a square. In each of the cases shown in FIG. 3A, 3B, and 3C, an individual opaque area is initially positioned over each of the displays between the pertinent sprockets individually referenced by letters A through H as appropriate in the FIGURES. When motivated, the tape-masks advance to advance a clear area of the tape at each display so that each of the displays is sequentially revealed. In order to achieve this, it is preferable that AB = BC = CD = DE = EF = GA. In this way, the clear area of the mask-tape can be stored toward an interior sprocket and can be advanced over the succeeding display. These basic embodiments shown in FIGS. 3A, 3B, and 3C, of course can be arranged with a plurality of lines of information, either textual or pictorial, and with a plurality of tape-masks. In such a case, each of the lines would be progressively revealed by sequential and progressive motivation of the tapes.

Figure 6:
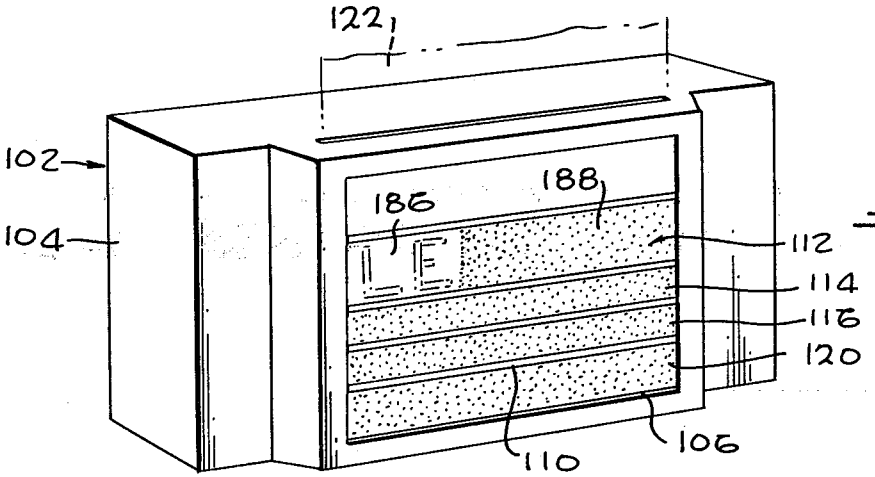
FIG. 6 is a perspective view of the preferred embodiment of the display as shown in FIGS. 4 and 5.

FIGS. 4, 5, 6, and 9 illustrate the preferred embodiment 102 of the device for sequentially revealing a display of this invention. FIG. 6 shows an external view, while FIG. 5 shows a horizontal section therethrough. Device 102 comprises a housing 104 in which the display itself and the structure for progressively revealing the display are housed. The housing is preferably of such nature as to protect the mechanism, confine stray illumination, and provide an attractive appearance. Window 106 in the front of the housing 104 is protected by glass or plexiglass 108. Interiorly of glass 108 is positioned stationary mask 110 which provides face masking of the display in the manner of frame 36 of FIG. 1. Behind face mask 110, positioned up and down the display, are four tape-masks 112, 114, 116, and 120. FIG. 5 illustrates the top structure, and thus tape-mask 112 is shown. Display 122 is positioned behind the tape masks. As previously discussed, the display may be any type of illustrative matter, including illustrations and three-dimensional works. However, for convenience of illustration of the preferred embodiment, display 122 has four lines of lettering, each to be progressively revealed. Lights 124 and 126 are positioned for front lighting, being positioned in front of mask 110. Lights 128 and 130 are positioned for edge lighting of display 122, particularly for those cases where display 122 is of acrylic or other material of light piping quality, and has display characterization or lettering therein by means of treatment which causes local light scattering. Back light 132 is positioned for rear lighting of the display. The front and edge lights are vertically oriented tubes, while the back lighting lights are horizontally oriented, preferably one behind each tape mask. In the case of a wide tape mask, a plurality of such lights can be employed behind the display. As is illustrated in FIG. 6, display 122 can be inserted and removed through the slot, to permit easy exchange of information.

FIG. 4 illustrates the four tape masks, each being mounted in its own structure. FIG. 4 illustrates that a plurality of these individual tape mask subassemblies can be stacked up, to choose the number of lines which are to be progressively revealed, and to choose the width of these lines. As is seen in FIG. 4, tape mask 112 is wider, such as 70 mm, while the tape masks 114, 116, and 120 are narrower, such as 35 mm. However, any convenient width can be used. Preferably, widths are standardized so that convenient assemblies from a plurality of subassemblies can be made, and some conveniently commercially available parts can be used.

Considering FIGS. 4 and 5, tape mask 112 engages around sprocketed drive roller 134 and flanged idler roller 136. Drive roller 134 has synchronization and driving capability of the tape and its sprocket teeth successively engage in sprocket holes 138 to drive the tape. Thus, synchronization between sprocketed roller 134 and tape 112 is obtained. The flanged roller 136 is merely an idler, and thus does not need sprocket teeth. Central shaft 140 extends through all of these drive rollers which are freely rotatable thereon. Shaft 140 is rigidly mounted in housing 104, at the top and the bottom. Shaft 142 carries the idler roller 136. Yoke 144 engages the top and bottom of shaft 142, outside of roller 136. Tension is applied to tape mask 112 by means of spring 146 engaged between the yoke and housing 104. Thus, tape 112 is tensioned.

Tape 112 is clear along half of its length and is opaque along the other half of its length. Driving of the tape with the sprockets rotating in the counterclockwise direction as seen in FIG. 5 causes tape motion in the direction of the arrow to progressively reveal the display thereunder. Sprocketed roller 134 is the driving roller and its driving causes the progressive revealing of the display. The sprocketed wheels of roller 134 are both secured to tube 148 (see FIG. 4) which is rotatably mounted on shaft 140. Gear 150 is fixed to tube 148.

Drive motor 152 is mounted on the bottom of housing 104. Drive motor 152 has a built-in or associated gear reduction so that its output shaft 154 rotates at a continuous constant low speed. Toothed drive gear 156 is fixed to shaft 154 to rotate therewith. It has external teeth as shown in FIG. 5, for engagement with the internal teeth in timing belt 158. Timing belt 158 is similar to those commerically available on the market. The conventional timing belts have impregnated cloth backing for tensile strength and have a series of equally spaced lugs internally projecting for engagement on drive gears. With this construction, timing belt 158 has the flexibility of a belt drive, together with the positive characteristics of chain or gear drive. There is a separate timing belt for each of the tape masks. Timing belts 158, 160, 162, and 164 are driven in synchronism by shaft 154 and each is respectively associated with tape masks 112, 114, 116, and 120.

Referring to FIG. 9, belt 158 is shown thereon. Belt 158 is divided into eight segments. Each of these segments is related to the different tape masks to be driven. Segments 166, 168, 170, 172, 174, 176, 178, and 180 are illustrated on timing belt 158. These segments are arranged along the length of the timing belt and are of equal length.

Considering FIG. 5, gear 150 is positioned directly adjacent the outer surface of timing belt 158. Timing belt 158 is provided with lugs on the external surface thereof. Lugs 182 are provided in segment 166 and lugs 184 are provided in segment 178. The device for progressively revealing the display is shown in FIG. 5 in a position wherein the top line of the display is being revealed. Clear portion 186 of tape 112 is moving from the back around roller 134 to the front, in front of display 122, while the opaque portion 188 is moving from left to right around roller 136 to the rear. Thus, the display is being progressively revealed from left to right as the tape mask moves. Drive is accomplished by means of the external lugs 182 on the exterior perimeter of belt 158 being in engagement with gear 150. The length of the lug segments, in conjunction with the diameter of gear 150, the diameter of drive roller 134 and the length of mask tape 112 is such that as the timing belt 158 moves through one segment, tape mask 112 moves through half of its circumference, i.e., overall length. As previously stated, half of its circumference is clear portion 186, while the other half is opaque portion 188. In the positon shown in FIGS. 4 and 5, segment 166 with its external lug teeth 182 is moving past gear 150. This is causing tape mask 112 to move from the opaque to the clear position, with the interface therebetween moving from left to right. Thus, the first line of the display is revealed. At the end of the revealing of the first line, timing belt 158 is in the position shown in FIG. 9.

As previously stated, each of the subassemblies is of similar construction, and each has a timing belt. Timing belt 160 is similar to timing belt 158 and is synchronized therewith. Each of the timing belts is driven by a gear which is fixed to shaft 158. Therefore, they move together. Timing belt 160 is the same, except that it has external drive lugs in segments 170 and 178. Timing belt 164 is the same, except that it has external drive lugs in segments 172 and 178. It can thus be seen when the external lugs 182 on timing belt 158 complete the movement of tape mask 112 from the opaque to the clear position, at the end of segment 166 and the beginning of segment 168, tape mask 112 stops. However, tape mask 114 starts because it is motivated by the external lugs in segment 168. When tape mask 114 has moved from the opaque to the clear position, it stops and tape mask 116 is then moved. After that, tape mask 120 is moved. Now, all display lines are revealed. Segements 174 and 176 do not have external lugs thereon, so that all of the display lines remain revealed through this period as the motor drives the timing belts. Next, segment 178 arrives at all of the drive gears 150. Each of the belts has external teeth 184 through segment 178. Thus, all of the tape masks are driven for half a circumference. In this segment, all the tapes are moved from the position where the clear portion is in front of the display to the position where the opaque portion is in front of the display. Thus, in segment 180, all of the tape masks are in the opaque position and awaiting the next cycle. Thus, one segment is devoted to having all of the tapes in the opaque position. Segment 166 next arrives and causes the first tape mask 112 to move from the opaque to the clear position to progressively reveal the first line again. Thus, the cycle is completed.

When the toothed segments of the timing belt leave gear 150, the rollers and the tape masks carried thereby are unrestrained. Since it is essential that they be held in synchronism, restraint is provided by means of ball detent 208 which is spring urged into a radial V groove 209. In this way, exact centering is achieved upon release of the tape mask drive roller from its drive belt. Intermittent detent action during the course of driven rotation of the sprocketed roller is overcome by the force of the drive. Thus, at the end of each driving portion of the cycle, the detent action maintains synchronization. Each of the tape mask drive sprocket rollers has a similar detent. The same detent structure is applicable to the intermittent drive shown in FIGS. 7 and 8.

There are other intermittent mechanisms which can control a plurality of motions. The toothed timing belt is the preferred embodiment, but other structures are also convenient. FIGS. 7 and 8 illustrate a structure wherein an intermittent gear drive is illustrated. Shaft 190 is continuously driven and extends through a plurality of subassemblies, each driving a tape mask over a particular portion of the display. One of the subassemblies is shown in FIG. 7 as having its own frame. Shaft 190 extends through all of the frames and rotates gears in each of the frames, to keep the various tape masks coordinated in position and in motion. In the particular frame 192 illustrated, gear 194 has teeth on only segments 196 and 198. Gear 194 is designed so that it is part of a four-tape mask display, and thus each of the segments is one-eighth of the gear circumference. Additionally, one-eighth of the circumference is left clear of teeth between the segments on one side thereof, and five-eighths is left clear on the other side of these segments. Pinion 200 lies adjacent gear 198 to be turned by the teeth on segments 196 and 198 when they pass. Through a speed-up mechanism comprised of gear 202 fixed to pinion 200 and pinion 204 in engagement with gear 202, toothed sprocket 206 is driven. The length of the segments and the gear ratio is such, as previously described, that for one segment on gear 194, toothed sprocket 206 drives the tape-mask one-half of its circumference. Different gears 194 are stacked up in the assembly so that each line of the display is progressively and sequentially revealed in synchronism. Preferably, idle time is provided when all of the display lines are revealed. After the idle time of a fully revealed display, moving of all the tape masks causes the display to become hidden. This is followed by another sequence of progressively and sequentially revealing the display. Thus, the structure of FIGS. 7 and 8 can be used to drive the tape masks of FIGS. 4 and 5 instead of the timing belts of the preferred embodiment.

This invention having been disclosed in its preferred embodiment, and other embodiments having been illustrated, it is clear that this invention is susceptible to numerous modifications and embodiments within the ability of those skilled in the art, and without the exercise of the inventive faculty.

What is claimed is:

1. A device for progressively revealing a display comprising:

a display having a viewable face;

a stationary mask defining viewable areas of said face;

first and second movable masks, each said movable mask having an opaque area and a clear area selectively positioned in front of the viewable face of said display, each said mask being movable across the face of said display, said masks being positioned adjacent each other and movable to cover and reveal adjacent portions of said display; and means connected to said movable masks for moving each said mask from a position wherein said opaque portion of each said mask is in front of said display, across said face so that said clear portion of said mask is in front of said face of said display so that said display is progressively revealed, said means for moving said mask comprising means for sequentially moving said first mask while said second mask is substantially stationary so that said first mask first progressively reveals a first one of said viewable areas of said display, and then moving said second mask while said first mask is substantially stationary so that said second mask progressively reveals a second one of said viewable areas of said display.

2. The device of claim 1 wherein said movable masks lie substantially adjacent each other and said masks are sequentially progressively moved in the same direction.

3. The device of claim 1 wherein each said movable mask comprises a continuous length of flexible mask tape material and wherein said opaque area is a substantially opaque area of said tape material and said clear area is a substantially transparent area of said tape material, said clear areas and said opaque areas being positioned adjacent each other along the length of said tape material.

4. The device of claim 3 wherein said clear area is of substantially the same length along said tape of flexible material as said opaque area.

5. A device for progressively revealing a display as defined in claim 4, wherein said tapes are each mounted on a single pair of rollers; and wherein said transparent area and said opaque area of each said tape each have a length substantially equal to the length of the viewable area which is selectively masked by each said tape, plus sufficient tape to extend around the respective pair of rollers on which each said tape is mounted.

6. The device of claim 3 wherein said tape material has sprocket holes therein, and said means for moving each said mask includes a roller having sprockets engaging said sprocket holes.

7. The device of claim 6 wherein a gear is connected to rotate said sprocketed roller, and wherein means are connected to said gear for intermittently rotating said gear to intermittently advance said tape material mask to intermittently progressively reveal said display.

8. The device of claim 7 wherein said intermittent means comprises a timing belt having continuous timing lugs on the interior thereof and having spacing groups of lugs on the exterior thereof, said exterior lugs being positioned to engage with said gear as said timing belt is advanced.

9. The device of claim 6 wherein there are first and second movable masks, said masks each being movable laterally across the face of said display, said masks being positioned adjacent each other in a direction to cover and reveal adjacent portions of said display, said means for moving each of said first and second masks including means for first progressively revealing a first one of said viewable areas of said display, and then progressively revealing a second one of said viewable areas of said display

10. The device of claim 9 wherein each of said tape material masks is driven by its own sprocket roller and separate intermittent means drives each of said sprocket rollers, and wherein power source means are provided for synchronously powering both of said intermittent means.

11. The device of claim 10 wherein said power source means comprises a rotating shaft and said intermittent means comprise first and second timing belts driven by said shaft, and first and second timing belts each having intermittently spaced lugs on the exterior surface thereof for respectively driving and first and second tape drive sprockets, and first and second timing belts having their exterior intermittent drive lugs being positioned at different points along the length of said timing belts so that said first and second tapes are successively driven to successively progressively reveal the display.

12. A device as defined in claim 1 wherein means are provided for concurrently moving all of said masks to a position where the opaque areas of all of said masks are positioned in front of the viewable face of said display, after a time interval during which the entire display has been fully revealed.

13. A device for progressively revealing a display comprising:

a housing adapted to receive a display;

a window in the front of said housing through which the progressive revealing of such viewable areas of said display can be viewed;

a stationary mask defining at least first and second viewable areas of said display;

at least first and second mask-tapes positioned within said housing and lying next to each other in substantially side-by-side relationship corresponding to said viewable areas, each of said mask-tapes having an active area positioned beneath said window, and each of said tapes having a transparent section and an opaque section longitudinally along the length of each of said tapes, said transparent section of said opaque section each being at least as long as the corresponding viewable area, said mask-tapes each being continuous and lying between said window and the display so that motion of the tapes causes the opaque section to be moved away from the window and the transparent section to be moved into the viewable area at said window to cause progressive revealing of said display, and sequential operation of said first and second tapes causes sequential revealing of said first and second viewable areas of said display; and motive means for sequentially and intermittently moving said tapes.

14. The device of claim 13 wherein said motive means comprises:

a motor, first and second drive gears driven by said motor, first and second timing belts respectively driven by said first and second gears, said timing belts having a toothed interior surface for engagement with said first and second gears and each having an exterior toothed section extending only partly along the exterior circumference of said timing belts, and exterior teeth causing sequential intermittent motion of said first and second tapes.

15. A device for progressively revealing a display comprising:

a housing adapted to receive a display;

a window in the front of said housing through which the progressive revealing of such viewable areas of said display can be viewed;

a stationary mask defining at least first and second viewable areas of said display;

at least first and second mask-tapes positioned within said housing and lying next to each other in substantially side-by-side relationship corresponding to said viewable areas, each of said mask-tapes having an active area positioned beneath said window, and each of said tapes having a transparent section and an opaque section longitudinally along the length of each of said tapes, said transparent section and said opaque section each being at least as long as the corresponding viewable area, said mask-tapes each being continuous and lying between said window and the display so that motion of the tapes causes the opaque section to be moved away from the window and the transparent section to be moved into the viewable area at said window to cause progressive revealing of said display, and sequential operation of said first and second tapes causes sequential revealing of said first and second viewable areas of said display;

motive means for sequentially and intermittently moving said tapes, said motive means including a motor, first and second drive gears driven by said motor, first and second timing belts respectively driven by said first and second gears, said timing belts having a toothed interior surface for engagement with said first and second gears and each having an exterior toothed section extending only partly along the exterior circumference of said timing belts, and exterior teeth causing sequential intermittent motion of said first and second tapes; said exterior teeth on said first and second timing belts being positioned at different segments along the exterior circumference of said first and second timing belts so that said first and second timing belts sequentially drive said first and second mask-tapes; and first and second sprocketed rollers connected to be driven by first and second gears and exterior teeth on said timing belts respectively engage said first and second gears to intermittently drive the first and second sprocketed rollers, said first and second mask-tapes being respectively driven by said first and second sprocketed rollers.

* * * * *